United States Patent [19]

Hunt et al.

[11] Patent Number: 4,525,885

[45] Date of Patent: Jul. 2, 1985

[54] SUPPORT APPLIANCE FOR MOUNTING ON A STANDARD HOSPITAL BED

[75] Inventors: William V. Hunt, Matravers; John A. Coletta; Richard J. Howling, both of Poole; Leonard Higgs, Bovington, all of England

[73] Assignee: Mediscus Products Limited, Wareham, England

[21] Appl. No.: 672,596

[22] Filed: Nov. 16, 1984

Related U.S. Application Data

[63] Continuation of Ser. No. 238,526, Feb. 26, 1981, Pat. No. 4,488,322.

[30] Foreign Application Priority Data

Feb. 26, 1980 [GB] United Kingdom ..... 8006375
Feb. 26, 1980 [GB] United Kingdom ..... 8006724

[51] Int. Cl.[3] ..... A47C 27/10; A61G 7/04

[52] U.S. Cl. ..... 5/453; 5/455; 5/469; 5/66

[58] Field of Search ..... 5/453, 454, 455, 456, 5/449, 423, 469, 66, 67, 68, 69

[56] References Cited

U.S. PATENT DOCUMENTS 3,822,425 7/1974 Scales ..... 5/456
3,909,858 10/1975 Ducker ..... 5/455

FOREIGN PATENT DOCUMENTS 1273342 5/1972 United Kingdom ..... 5/455
1474018 5/1977 United Kingdom ..... 5/67
1545806 5/1979 United Kingdom ..... 5/455

*Primary Examiner*—Alexander Grosz
*Attorney, Agent, or Firm*—Robert B. Russell

[57] ABSTRACT

A support appliance is provided with a base structure comprising a plurality of hinged base boards arranged to be mounted on a standard hospital bed and providing a continuous, firm, base underlying a plurality of inflatable patient supporting air sacs to which air is supplied from headers supported by said base structure which headers are individually supplied with air under pressure by flexible conduits releasably connected to pressurized air supply conduits in a single housing connected at an edge of said base structure.

3 Claims, 8 Drawing Figures

SUPPORT APPLIANCE FOR MOUNTING ON A STANDARD HOSPITAL BED

This application is a continuation of application Ser. No. 238,526, filed Feb. 26, 1981, now U.S. Pat. No. 4,488,322.

BACKGROUND OF THE INVENTION

This invention relates to support appliances and is in particular concerned with the construction of a mattress or bed in which a plurality of inflatable air sacs provide a support surface. In our British Patent Specification No. 1,474,018 there is described a bed of the above type which includes air operated bellows for raising and lowering the foot and/or head of the bed. The bed described in this British patent specification includes a sub-frame which is pivotably mounted on a carriage and includes means such as an electrically driven rack for altering the attitude of the sub-frame with respect to the carriage. The inflatable air sacs are mounted on support members which are pivotably connected to the sub-frame and bellows are provided for altering the angle of the support members with respect to the sub-frame.

While the bed described in our above mentioned patent specification has proved to be successful and effective in nursing seriously ill patients, there is a need for a support appliance which can be made more cheaply and can be fitted to a standard hospital bed frame.

DISCLOSURE OF INVENTION

According to the present invention there is provided a mattress wherein conduits are connected to a plurality of header chambers incorporated in the mattress or in a cover therefor, inflatable air sacs being mounted on the mattress and connected to ports in the chambers so that air can be supplied to the sacs via the conduits, the conduits being normally contained within the confines of the mattress.

The mattress is constructed so that it can be contoured, i.e. shaped to suit the person occupying it, without substantially impeding the air flow to the air sacs.

With this objective in mind a major part of the interior of the mattress is constructed from foamed plastics or rubber material and the conduits and header chambers are sufficiently flexible so that the mattress can be contoured in use or even rolled up for easy transportation and storage.

In use, the mattress may be laid on the base of a standard hospital bed such as the standard bed used in the British National Health Service and termed the "King's Fund Bed". This is a rigid, tubular steel framed bed. Alternatively the mattress may be supported on any other flat surface of convenient height.

The inflatable sacs are preferably mounted transversely of the mattress and connected to the header chambers on opposite sides by releasable connectors. Air may be passed into the header chamber on one side of the mattress and exhausted from the air sac on the opposite side through the corresponding exhaust header chamber. A control valve is normally provided to control the flow of air which is allowed to escape from the exhaust header chambers. In this way, the pressure and rate of flow of air through each air sac or group of air sacs can be individually controlled.

The air sacs may be divided into groups in a similar way to the sacs in our British Patent No. 1,474,018 so that the sacs in each section can be raised to a pressure which is appropriate for the part of the patient's body which is to be supported at that point. As described in our British patent specification No. 1442944 and in the book "Bed Sore BioMechanics" edited by R. M. Kennedy, J. M. Cowden and J. T. Scales published by Macmillan, 1976, pages 259–299, adjustment of the pressure of the air sacs on which the patient is supported and of the throughflow of air through the sacs or bags to maintain the skin of the patient at the optimum temperature, greatly reduces the incidence of bed sores.

The contour or overall shape of the mattress can be adjusted when it is placed on a standard hospital bed by providing air operated bellows similar to those described in our British Patent No. 1,474,018. The bellows are arranged to act between the head of the mattress and a baseboard placed on the base frame of the bed or between the foot of the bed and a similar baseboard placed on the base surface of the bed at its foot. A single or connected baseboard may be employed. These bellows can be operated by air supplied through conduits which pass either through the interior of the mattress or are connected via external conduits. Conveniently the air inlet and exhaust ports and control valves therefore are grouped together and may be contained in a single housing or pair of housings located at one end of the mattress.

The present invention also includes a novel construction of remotely operated air valves which can be used for a variety of purposes but is particularly suitable for operating the bellows for contouring the mattress as described above or for operating the bellows for contouring the bed described in our above mentioned British Patent No. 1,474,018.

The invention, therefore, includes a remotely operated air valve which comprises a chamber having an inlet and an outlet, the outlet including a tube which projects into the chamber and the chamber being divided by a flexible diaphragm so that the inlet and outlet in the same part of the chamber, the diaphragm being movable between two extreme positions in one of which the diaphragm seals the end of the inlet tube and the other allows air to escape into the chamber through the tube, the other part of the chamber being pressurized and the position of the diaphragm being controllable by venting or not venting air from the second part of the chamber.

DESCRIPTION OF THE DRAWINGS

Various aspects and features of the present invention will now be described with reference to the accompanying drawings in which.

DETAILED DESCRIPTION OF THE INVENTION

Figure 1:
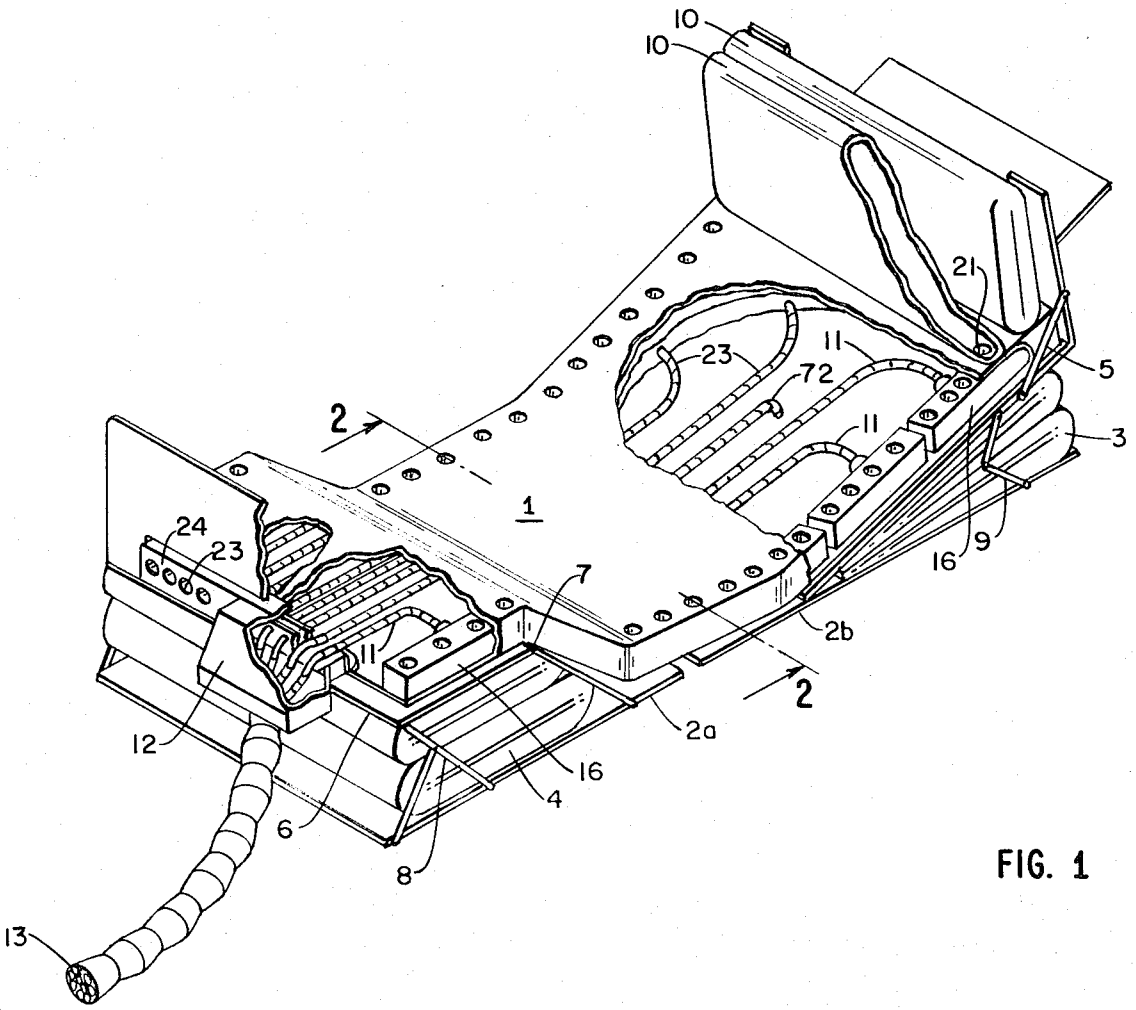
FIG. 1 is a perspective view of a mattress in accordance with the invention, partly broken away to show the interior and with only 2 air sacs shown.

Referring to the drawings, FIG. 1 shows a perspective view of the mattress which can be supported on the base frame of a bed. The mattress comprises a tough, flexible, plastic outer cover 1 which is filled with a foamed plastics or foamed rubber interior. A semi-rigid polyurethane or polyether foam is preferred since a firm base is desirable. However, the mattress should be flexible enough to be contoured into the configuration shown in FIG. 1 and to recover to take up a generally flat configuration. The foam interior of the mattress is shaped to form passageways to receive air supply and exhaust conduits which will be described in detail later.

A baseboard, *2a* and *2b*, conveniently formed from plywood, is joined by a suitable connector for ease of transportation and provides a base for a pair of bellows 3 and 4. As can be seen in FIG. 1, the bellows each consist of two interconnected air bags and their internal construction and method of operation is very similar to that of the bellows described in our British Patent No. 1,474,018. The bellows act between the baseboards *2a* and *2b* and mattress support boards 5 and 6. Boards 5 and 6 are hinged at one end to the baseboard and board 6 is articulated at 7 so that the foot part of the mattress can be raised to form a plateau. Guide struts 8 and 9 connect the upper boards with the baseboards and also prevent distortion or slipping of the bellows from between the boards. It is not essential to provide bellows at both the foot and head of the bed.

Figure 6:
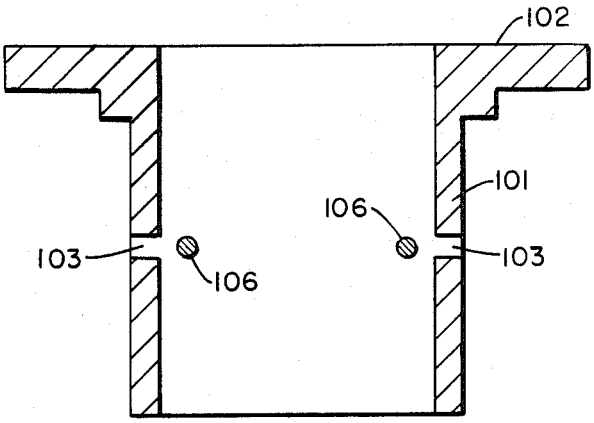
FIG. 6 is a sectional elevation of the female part shown in FIG. 5.

A support surface for the occupant of the mattress is provided by a plurality of inflatable air sacs or bags 10. For clarity only 2 bags are shown in FIG. 1 but in a typical mattress there will be about 20 air sacs which are grouped in 5 groups of 4 sacs each. The arrangement of the air sacs is similar to that shown in our British Patent Nos. 1,442,994 and 1,474,018. As described in our prior patents each group of air sacs is supplied with air at an individually controlled temperature and pressure. In this way the different parts of the patient's body are effectively supported with uniform pressure over the area of the body and the support surface corresponds to the precise shape of the patient's body. This reduces formation of bed sores and accelerates healing of damaged skin. Air is arranged to pass through the air sacs in the direction shown by the arrows in the broken-away air sac 10 in FIG. 1 and this is important for maintaining the comfort of the patient by control of body temperature and evaporation of body sweat and fluids exuded from wounds. Air is supplied to the inflatable sacs 10 by means of conduits 11 extending internally of the mattress and connected in a housing 12 to conduits 13 which are supplied with air from a blower unit (not shown). The blower unit can be as illustrated in FIG. 6 in our prior British Patent No. 1,474,018. The disclosures of this patent and of British Pat. No. 1,442,994 are specifically incorporated herein.

Figure 2:
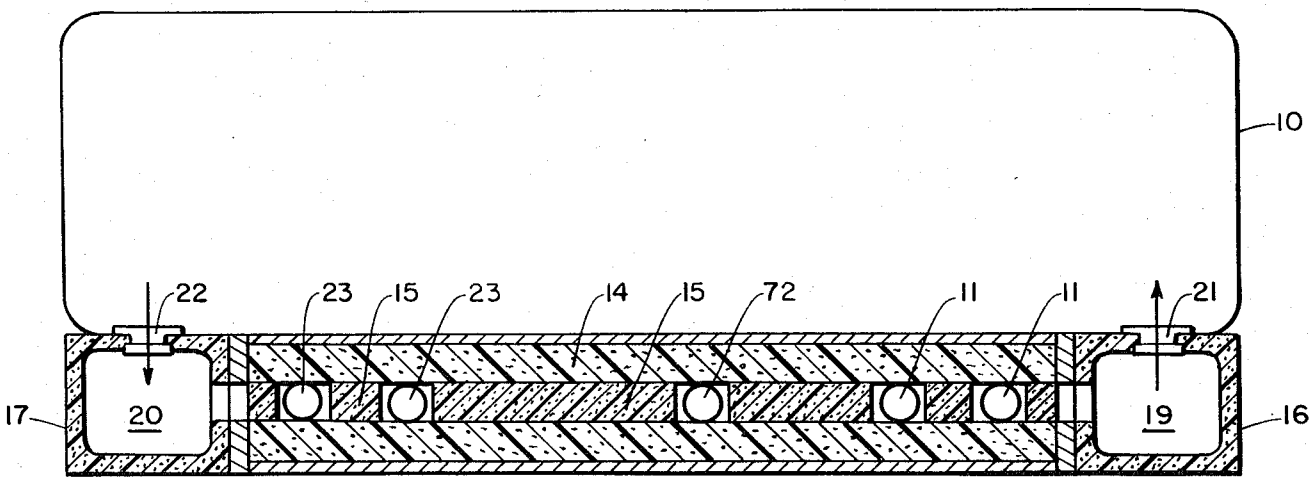
FIG. 2 is a section taken on the line A—A in FIG. 1 and showing an inflatable air sac in position.

FIGS. 1 and 2 show the internal construction of the mattress. The mattress comprises a stout, flexible reinforced plastics outer case 1, the interior of which is filled with plastics or rubber foam, the foam being in the form of slabs 14 and 15 which are shaped to define passage-ways for reception of air supply and exhaust conduits and also the conduits for supplying air to the bellows 3 and 4. The foam 14 and 15 is bonded together with a suitable adhesive. Housed in longitudinal pockets 16 and 17 on opposite sides of the mattress are a series of header chambers 19 and 20. In the arrangement illustrated, chambers 19 are designated the supply headers and chambers 20 the exhaust header chambers. Chambers 19 are supplied with air through conduits 11, the conduits 11 being arranged to enter the mattress at one end through a common housing 12 attached to the foot of the mattress.

Inflatable air sacs 10 are mounted transversely of the mattress and are connected to oppositely aligned connectors 21 and 22 thereby coupling chambers 19 and 20 in respective pockets 16 and 17. In use, air is supplied from a blower unit (not shown) which contains pressure control valves for each supply conduit and thermostatically controlled heaters. Air then passes through connectors 21 into the air sacs 10 and then out through a corresponding exhaust header chamber 20. Air is exhausted from chambers 20 via conduits 23 and the rate of exhaust of air from each conduit is controlled by a flow control valve 31 located in a common housing 24. The chambers 19 and 20 are arranged transversely in pairs and are individually supplied and exhausted with air via separate control valves so that pressure in each group of sacs can be individually controlled. FIG. 1 provides for five groups of 4 inflatable sacs but it would be appreciated that the number can be varied according to the sophistication required.

Figure 3:
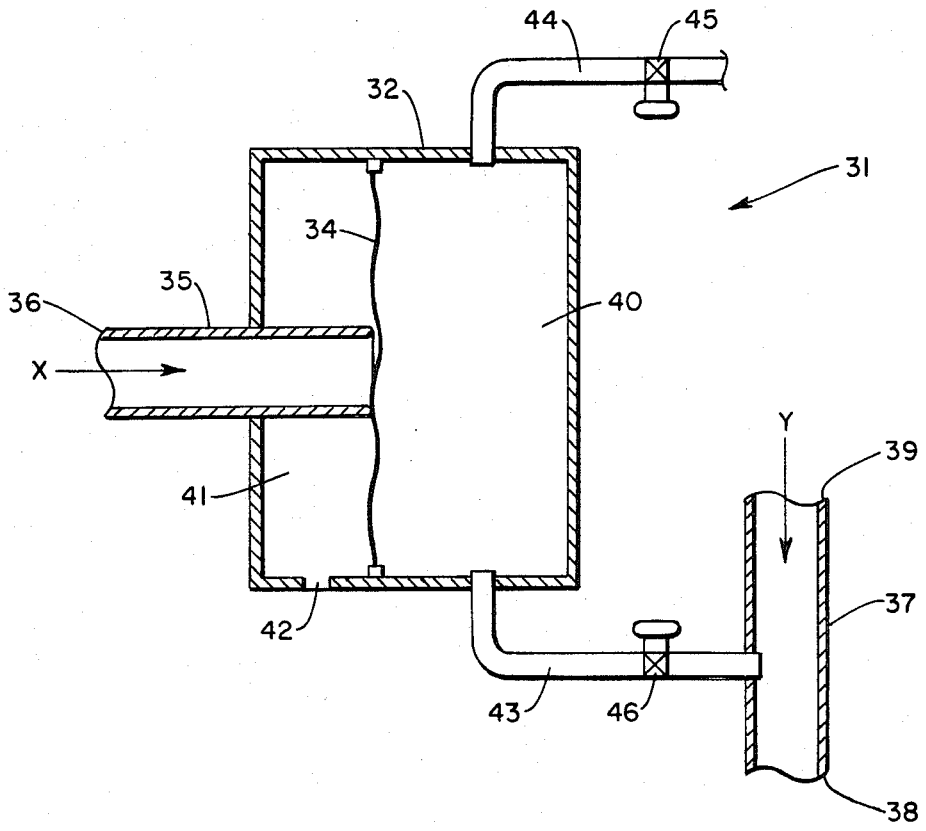
FIG. 3 is a sectional view of a control valve for supplying air to the mattress.

Each exhaust header chamber 20 is provided with a flow control valve 31 whose construction is shown diagrammatically in FIG. 3. Each control valve 31 is linked to the corresponding supply conduit so that air flow through each group of air sacs can be maintained constant as described below. As can be seen, the valve 31 comprises a chamber 32 which is divided by a flexible diaphragm 34 into chamber housings 40 and 41. A tube 35 enters the chamber from one side and the end 36 of tube 35 is connected to an exhaust conduit 23 from a header 20. Accordingly, air will exhaust from chamber 20 in the direction of arrow X in FIG. 3. Tube 37 is connected at one end 38 to supply conduit 11 coupled to chamber 19 which is paired with the chamber 20 to which tube 35 is connected. The other end 39 of tube 37 is connected to the source of pressurized air via a pressure control valve (not shown) in the blower supply unit. Tube 37 is linked to the chamber 40 by a small bore flexible tube 43. Air is supplied to tube 37 in the direction indicated by arrow Y in FIG. 3.

Figure 4:
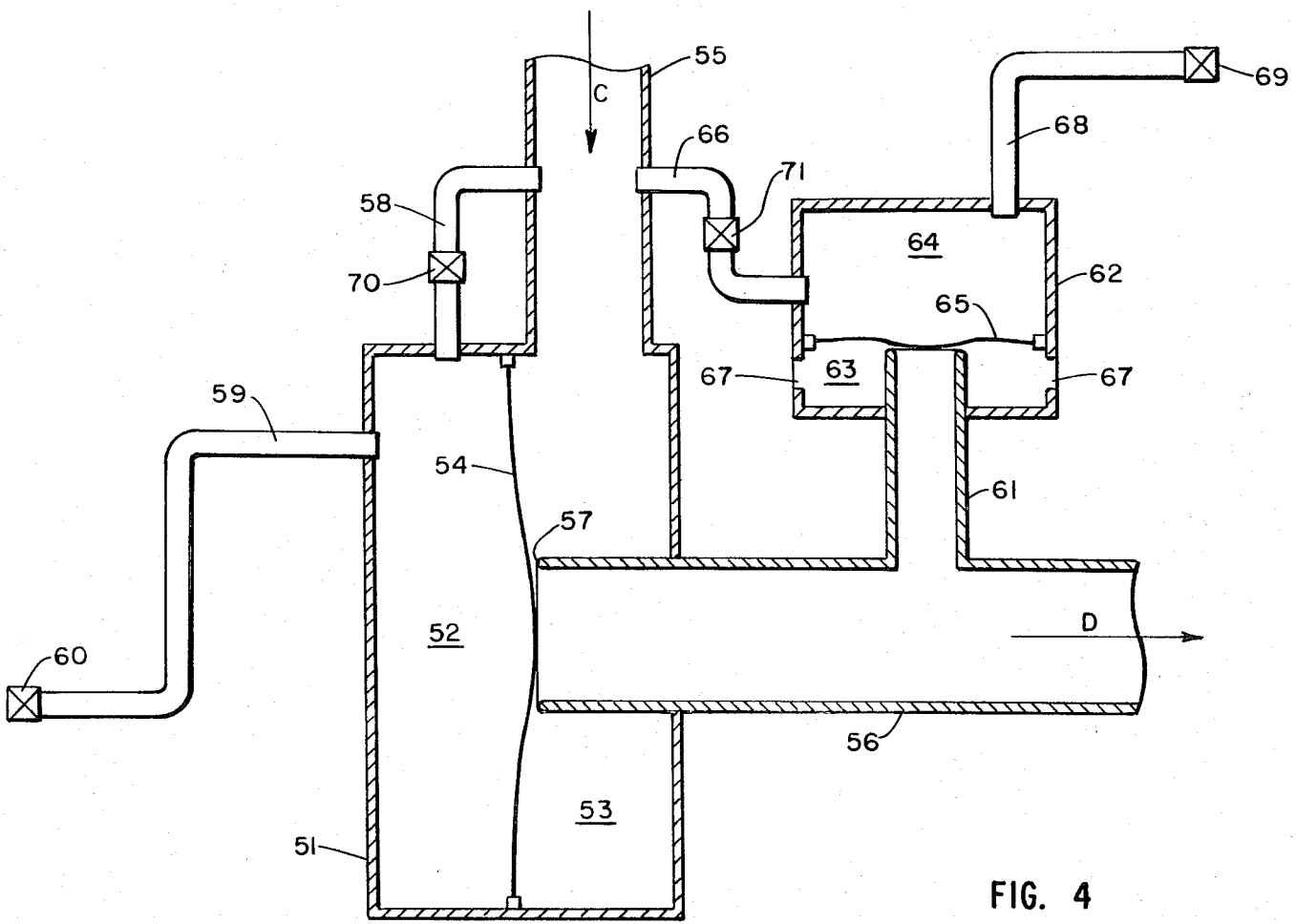
FIG. 4 is a diagrammatic sectional view of a remotely operated air valve.
Figure 5:
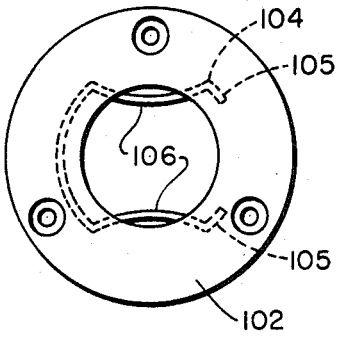
FIG. 5 is a plan view of one end of the female part of a connector for attaching an air sac to a mattress.

The valve 31 operates in the following manner: Air is supplied in direction Y into the air sacs 10 and flows out through chamber 20 and the conduit 23 into tube 35 in the direction indicated by arrow X. In its steady state there is a small clearance between the inner end of tube 35 and the diaphragm 34. Thus, in normal use there is a slow leak of air between the end of tube 35 and diaphragm 34 and out of the valve through port 42. If an air leak should develop in the circuit, for example, owing to the development of greater porosity in the fabric forming the air sac 10 after washing, there would be a loss of air from the system and the air flow through the sac would otherwise reduce. This effect is compensated by the valve 31 automatically in the following manner: Greater leakage of air in the system will cause the pressure differential between air in tube 37 and that in tube 35 to increase. Since tube 37 is linked to chamber 40 by tube 43, this will cause the diaphragm 34 to be pressed more tightly against the end of tube 35. As a consequence, less air will escape from port 42 and the total air flow to the air sac 10 will be maintained. Thus, it is no longer necessary to juggle with both a pressure supply valve and an exhaust valve when leakage characteristics of the air sacs change since the compensator valve automatically takes account of such variations. Chamber 40 also has an outlet tube 44 and tubes 43 and 44 are fitted with adjustable throttle valves 45 and 46. Valves 45 and 46 are adjusted when installing the mattress so as to balance the pressure acting on the diaphragm 34 and provide a regulated escape of exhaust air due to any changes in air sac flow rate. The exhaust air passes through the port 42 and escapes to atmosphere through holes in the cover of housing 24. FIG. 4 illustrates a remotely operated air valve suitable for controlling air supply and exhaust to bellows at the head and foot of the mattress. Referring to FIG. 4, a first chamber housing 51 is divided into two parts 52 and 53 by a diaphragm 54. An inlet tube 55 is connected to an air supply conduit to supply air in the direction of the arrow C to chamber 53. A tube 56 enters chamber 53 so that its end 57 is in close proximity to diaphragm 54. Tube 55 and chamber 52 are connected by a small bore tube 58 and housing value 70. Chamber 52 can be exhausted through a small bore flexible tube 59, the exhaust of air through which can be controlled by a hand-operated valve 60.

Tube 56 is fitted with a branch tube 61 and tube 61 enters a second chamber housing 62 which is also divided into two chambers, 63 and 64 by a flexible diaphragm 65. Chamber 64 is connected to supply tube 55 by a small bore flexible tube 66 housing valve 71 and chamber 63 is provided with ports 67 to allow air to escape to atmosphere. Chamber 64 in addition is provided with a flexible tube 68 through which air may be vented to atmosphere under the control of a manually operated valve 69.

Tubes 58 and 66 are fitted with flow control valves 70 and 71 so that the air flow there along can be controlled by adjustment of these valves.

The valve operates as follows:

With manually controlled valve 60 open, air will flow along tube 59 into chamber 53 and press diaphragm 54 away from the end 57 of tube 56. This will allow air to pass along tube 56 in the direction of arrow D into the bellows for the head of the bed. While manual control valve 69 remains closed, diaphragm 65 in chamber housing 62 will remain pressed against the end of tube 61 and no air will pass there along.

When it is desired to exhaust the bellows, valve 60 is closed and valve 69 is opened. Closing of valve 60 will cause the pressure to rise in chamber 52 to a level which is at least equal to the pressure in chamber 53. Because the area of the diaphragm 54 subjected to pressure in chamber 52 is greater than the area in chamber 53, diaphragm 54 will close over the end of tube 57 and prevent further air entering tube 56. At the same time, pressure in chamber 64 will fall as valve 69 is opened and this will cause diaphragm 65 to move away from the end of tube 61. Consequently air will flow out of the bellows and escape from the system via tube 61, chamber 63 and ports 67.

One remotely operated air valve is normally provided to control the head raising bellows 3 and a second similar valve to control the foot bellows 4. The valves can be located at any convenient location, for example, within the housing 12 or in the blower unit. Valves 60 and 69 can be located in a hand control unit so that the patient or a nurse may operate the bellows. It will be appreciated that the use of remotely operated air valves and bellows and low pressure air to power the raising and lowering of the head and foot sections of the mattress is a very safe system and in particular avoids the need for any electrical connections to the bed or controls operated by the nurse or patient.

As can be seen from FIGS. 1 and 2, the conduits 72 for feeding and exhausting air to and from the head bellows 3 extends through the mattress. Although not specifically shown, the conduit from the foot bellows also passes through the mattress. Thus, all connections for supplying and exhausting air from the air sacs and the bellows pass through the housings 24 and 12 mounted at the foot of the mattress.

FIGS. 5 to 8 show the construction of the connectors 21 and 22 for filling the air sacs 10 to the header chambers. Referring to FIGS. 5 to 8, the female part comprises a tubular member 101 having a flange portion 102 to facilitate attachment of the female part to an air supply header tank (not shown). As can be seen, the tubular part 101 is formed with a pair of slots 103 which are disposed opposite to one another for reception of a metal spring 104 which provides the latch in the embodiment illustrated. Spring 104 is of generally U-shaped form and is provided with inturned legs 105 to ensure retention of the spring in the slots 103. As can be seen best from FIG. 5, the oposite arms of spring 104 have portions 106 which extend into the space contained by tubular member 101.

Figure 7:
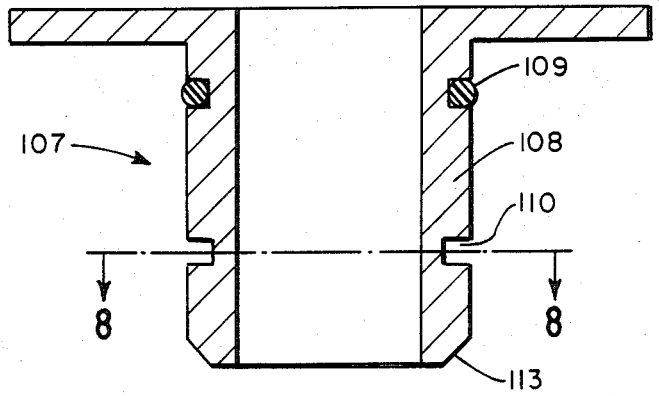
FIG. 7 is a sectional elevation of the male part and FIG. 8 is a sectional view taken on the line B—B in FIG. 7.
Figure 8:
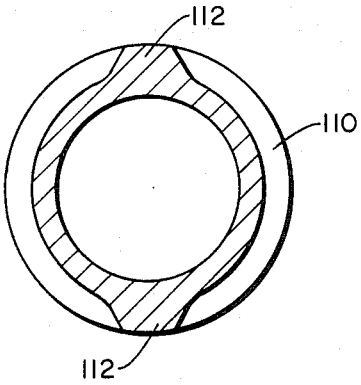

The other part of the connector shown in FIG. 7 comprises a male part 107 having a tubular portion 108 which is sized so as to slide easily into the tubular part 101 of the female half of the connector. Tubular part 108 is formed with two pairs of grooves 109 and 110. Groove 109 is arranged to receive an O-ring 111 and extends around the entire circumference of tubular part 108. Groove 110 is dimensioned so as to receive the portions 106 of spring 104 when the two halves of the connector are assembled. In this position, with the portions 106 of spring 104 nested in the grooves 110 and the O-ring 111 bedded against the inner wall of tubular portion 101, the two halves of the connector are secured against being pulled apart under the pressure of air passing though the connector. As shown best in FIG. 8, the groove 110 does not extend completely around the tubular portion 108 but consists of two separate grooves which are cut so as to leave two short portions of the outer wall 112 intact in diametrically opposite portions of tubular part 108. Thus, when the two halves of the connector are rotated relatively to one another, portions of spring 106 ride up on the uncut portions 112 of tubular part 108 and allow the two sections to be pulled apart. The end of male part 107 remote from the flange is formed with a lead chamfer 113 to enable the spring 104 to be displaced as the part 107 is inserted into the part 101.

The two parts 101 and 107 of the connector are conveniently manufactured from a plastics material, such as nylon or polypropylene, and are preferably injection molded. Although the connectors 21 and 22 have been described for use with the mattress shown in FIGS. 1 and 2, they are of course, equally suitable for connecting the air sacs to the supply and exhaust header chambers in the beds described in our British Patents Nos. 1,442,994 and 1,474,018. In fact, the connectors shown in FIGS. 5 to 8 are useful in any kind of low-pressure air supply system, where pressures of up to about 2–5 lbs per square inch are employed, e.g. inflatable air beds, vacuum cleaners and inflatable boats.

According to a further aspect of the present invention there is provided therefore a connector for use with a low-pressure air supply conduit which comprises male and female tubular parts, the male part having a recess for reception of a resilient latch member carried by the female part when the two parts are assembled together and a portion of the male part being shaped so as to raise the latch when the two parts are rotated relatively to one another and thus to enable the two parts to be disassembled.

Preferably the air sacs 10 (or the upper surface thereof) is made from a microporous fabric which is non-permeable to air but is permeable to water vapor. One such material is a microporous polyurethane-coated nylon manufactured by Carrington and Dewhurst under the trade-mark Permatex.

We claim:

1. A support appliance for mounting on a standard hospital bed comprising:

(a) a separate, self-contained base structure adapted to be fitted onto a standard hospital bed;

(b) a plurality of elongated inflatable air sacs for supporting a patient arranged in groups longitudinally relative to said bed frame, said groups each corresponding to different portions of the body of a patient lying on said appliance, each said sac having a surface for supporting the patient at least a portion of which surface comprises a microporous fabric which is permeable to water vapor but not to liquid;

(c) said base structure comprising at least three hinged base boards approximately corresponding respectively to the upper body, seat and leg portions of the patient;

(d) elongated air supply header chambers supported by said base boards, each header of which is respectively adapted to supply compressed air to each said group of sacs, each said header having discreet openings in its upper surface aligned and spaced therealong;

(e) separate flexible header air supplying conduits one for each of said headers and respectively connected thereto;

(f) releasable means for connecting each sac to a corresponding header chamber at a respective discreet opening thereof and for aligning said sacs transversely of and contiguously from end-to-end of said base structure;

(g) an air supply conduit housing connected along one edge of said base structure;

(h) a plurality of flexible exterior conduits leading to said housing each corresponding to a separate one of said header air supplying conduits;

(i) said header air supplying conduits leading from said headers to said housing at the edge of said base structure; and (j) releasable means associated with said housing for interconnecting said respective header supply and exterior conduits.

2. The patient support claimed in claim 1 additionally comprising means for providing a continuous, flat, firm base under said sacs at least in the thorax area of the body of the patient.

3. The patient support claimed in claim 1 additionally comprising means for passing air into each said sac at one point, through said sac and out of said sac at other points.

* * * * *